United States Patent [19]

Williams

[11] 4,412,692

[45] Nov. 1, 1983

[54] APPLIANCE FOR A BOOK OR THE LIKE

[76] Inventor: Donald E. Williams, 2479 S. Poppy, Fresno, Calif. 93706

[21] Appl. No.: 234,767

[22] Filed: Feb. 17, 1981

[51] Int. Cl.[3] ..... B42D 3/04; B42D 3/18; B42D 9/00

[52] U.S. Cl. ..... 281/34; 281/42

[58] Field of Search ..... 281/31, 38, 42, 34, 281/29

[56] References Cited

U.S. PATENT DOCUMENTS

| | | | |
|---|---|---|---|
| 1,595,002 | 8/1926 | Davis | 281/34 |
| 2,190,055 | 2/1940 | Davidson | 281/34 |
| 3,140,833 | 7/1964 | Anthony | 281/34 |
| 3,298,714 | 1/1967 | Celmer | 281/42 |
| 3,981,522 | 9/1976 | Bloom | 281/34 |
| 4,162,800 | 7/1979 | Gonot, Jr. et al. | 281/42 |

FOREIGN PATENT DOCUMENTS

| | | | |
|---|---|---|---|
| 814294 | 6/1937 | France | 281/42 |
| 6724 | of 1895 | United Kingdom | 281/34 |

*Primary Examiner*—Paul A. Bell

*Attorney, Agent, or Firm*—Huebner & Worrel

[57] ABSTRACT

An appliance for a book or the like having an outer panel with portions for securing the outer panel on the book, and a member mounted on the outer panel movable to and from a position within the book for marking a selected portion of the book.

1 Claim, 7 Drawing Figures

APPLIANCE FOR A BOOK OR THE LIKE

BACKGROUND OF THE INVENTION

1. Field of the Invention

The present invention relates to an appliance for a book or the like and more particularly to such an appliance which permits books, pamphlets and other bound materials to be enclosed in a protective outer jacket in such a manner as simultaneously to equip the book with the capability for marking selected pages thereof.

2. Description of the Prior Art

Bookmarkers of a variety of types have long been known which are separate and distinct from any book in which they are used. Similarly, it has been known to bind books with a string or ribbon permanently affixed to the binding for purposes of serving as a bookmarker. For example, Bibles are often bound so as to afford such strings or ribbons.

There are innumerable situations, however, in which it is desirable to retain the capability under any conditions of marking one or more selected pages of a book not otherwise provided with a bookmarker. Similarly, there are circumstances in which it would be desirable to retain selected pages of a book in a captured condition while reading or otherwise using other portions of the book. This is particularly the case with respect to school books and reference books where it is frequently necessary to use several pages of the book for reference during any given period of time. It is also desirable to protect a book during such concentrated usage from undue wear. There has, heretofore, been no convenient, economical and fully effective device for achieving these objectives.

Therefore, it has long been known that it would be desirable to have an appliance which is capable of being installed on virtually any book, pamphlet or the like in such a manner as to provide external protection for the book while imparting the capability for marking selected pages or portions of the book to facilitate the use thereof.

SUMMARY OF THE INVENTION

Therefore, it is an object of the present invention to provide an appliance for a book or the like which is adaptable for use on virtually any type or size of bound volume and which possesses the capability for selectively marking one or more pages of the bound volume.

Another object is to provide such an appliance which can be installed as a protective cover for a book or the like while affording the capability for individually marking a plurality of selected pages of the book on which the appliance is installed.

Another object is to provide such an appliance which has marking members which are so arranged as to minimize the possibility that they may inadvertently become dislodged.

Another object is to provide such an appliance which has compartments for stowing the marking members thereof when not in use in a manner such as not to interfere with normal use of the book.

Another object is to provide such an appliance which possesses the capability for physically capturing any number of pages of the book.

Another object is to provide such an appliance which provides the foregoing operative capabilities, but which does not interefere with normal usage of the book.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENTS

First Form

Figure 2:
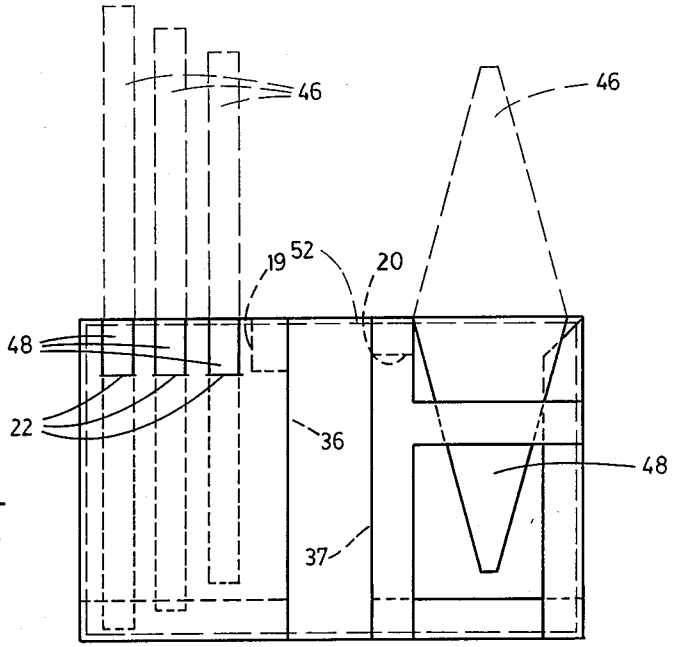
FIG. 2 is a plan view of the appliance of FIG. 1 shown in an assembled condition with a book shown in phantom lines as installed therein and the marking members of the appliance shown in full lines in respective stowed positions and in phantom lines in respect to extended positions.
Figure 1:
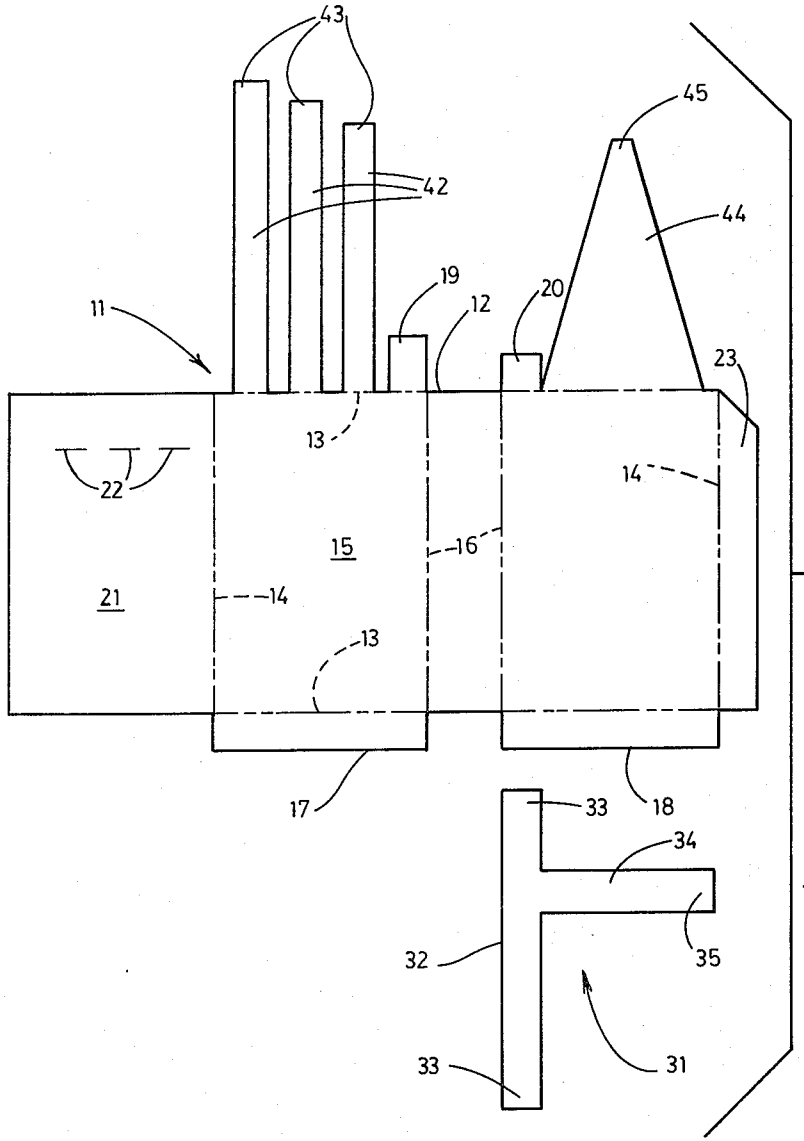
FIG. 1 is a plan view of the appliance of the first form of the present invention shown in a preassembled, substantially flat configuration.
Figure 3:
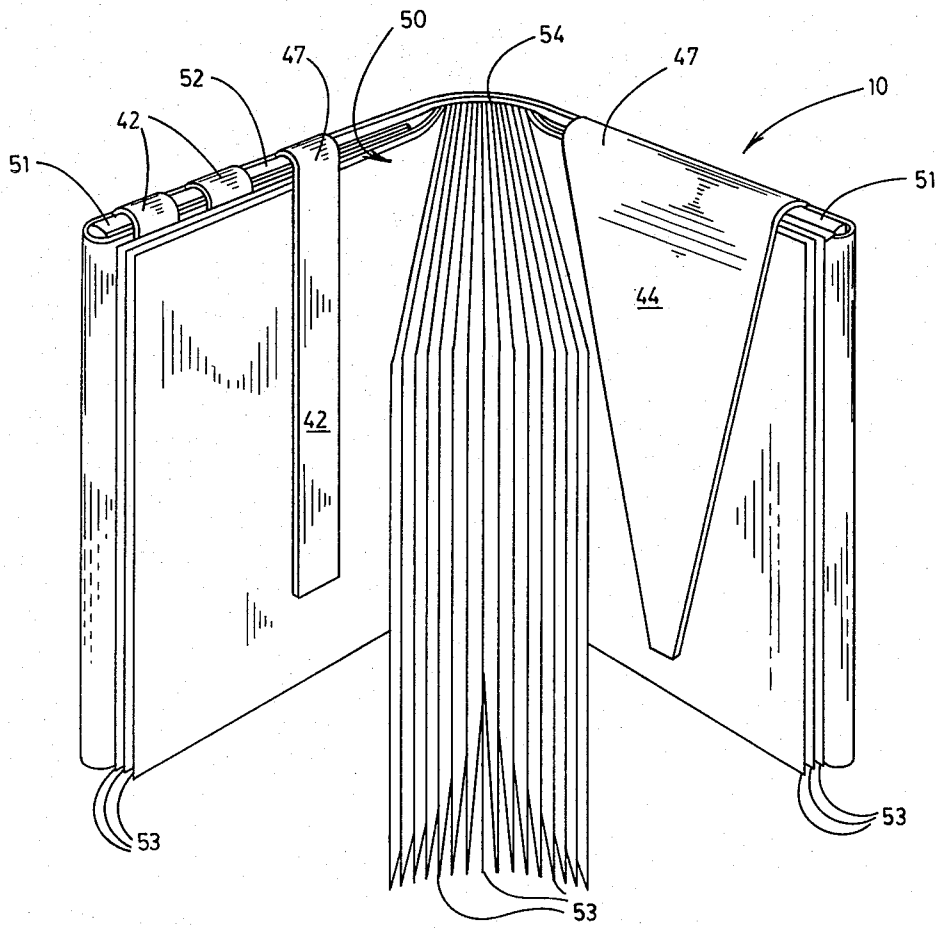
FIG. 3 is a perspective view showing a book with the appliance of the first form of the present invention installed thereon in a representative operative configuration.

Referring more particularly to the drawings, the appliance of the first form of the present invention is shown in FIGS. 1, 2 and 3 and generally indicated by the numeral 10. Referring more particularly to FIG. 1, the appliance 10 is preferably, although not necessarily, formed from a construction blank 11 of sheet material, such as paper, cardboard, plastic or the like. When fully assembled, as will herein be described, the construction blank forms a secondary cover or outer jacket 12 for the appliance.

The construction blank 11 has a pair of spaced, substantially parallel longitudinal marginal fold lines 13 and a pair of spaced substantially right angularly related transverse marginal fold lines 14 which bound an outer panel 15 for the outer jacket 12. The outer panel has a pair of substantially parallel central fold lines 16 extending transversely of the construction blank between and substantially parallel to the transverse marginal fold lines 14.

The lower longitudinal marginal fold line 13 of the construction blank 11, as viewed in FIG. 1, delineates a left lower flap 17 and a right lower flap 18 extending from their respective transverse marginal fold lines 14 to their respective adjacent central fold lines 16. The upper longitudinal marginal fold line 13, as viewed in FIG. 1, delineates a left upper flap 19 and an opposite right upper flap 20. The transverse marginal fold line 14 on the left, as viewed in FIG. 1, delineates a first inner panel or left side flap 21 having three slots 22 extending therethrough in the predetermined positions shown in FIG. 1. The transverse marginal fold line 14 on the right, as viewed in FIG. 1 delineates a right side flap 23.

The appliance 10 of the first form of the present invention has a second construction blank 31 shown in FIG. 1. The second construction blank has a second inner panel, sleeve or transverse portion 32 having opposite end portions 33. The second construction blank has a longitudinal portion 34 preferably integral with the transverse portion and itself having an end portion 35.

The outer jacket 12 is formed from the construction blanks 11 and 31. This is accomplished by folding the left and right lower flaps 17 and 18 and the left and right upper flaps 19 and 20 about their respective longitudinal marginal fold lines 13 and into engagement with the outer panel 15. Subsequently, the left side flap 21 is folded about its respective adjacent transverse marginal fold line 14 into engagement with the left upper flap 19 and the left lower flap 17 and attached thereto by a suitable adhesive, not shown. Similarly, the right side flap 23 is folded about its adjacent transverse marginal fold line 14 into engagement with the right lower flap 18 and adhesively attached thereto. Thereafter, the second construction blank 31 is positioned on the construction blank 11, as best shown in FIG. 2. The opposite end portions 33 of the transverse portion 32 are individually adhesively attached to the right upper flap 20 and the right lower flap 18. The end portion 35 of the longitudinal portion 34 is adhesively attached to the right side flap 23. The outer panel 15 and the left side flap 21 of the outer jacket 12 so formed define a left pocket 36. Similarly, the second construction blank 31 and the outer panel 15 form a right pocket 37 for the outer jacket 12.

The construction blank 11 mounts three marking members 42 which are preferably integral therewith extending outwardly from the upper longitudinal marginal fold line 13, as shown in FIG. 1. The marking members are preferably arranged in spaced relation individually aligned with the three slots 22 of the left side flap 21. Each of the marking members has a remote or free end portion 43 and is preferably of substantial length as shown in FIG. 1. The construction blank has a marking member or flap 44 integral therewith and extending outwardly from the upper longitudinal marginal fold line 13, as shown in FIG. 1, between the right upper flap 20 and the right side flap 23. The marking flap 44 has a remote or free end portion 45. As shown in FIG. 2, the marking members 42 and 44 individually have extended or first positions 46 shown in phantom lines in FIG. 2. As shown in FIG. 3, the marking members have marking or second positions 47. The marking members are positionable in stowed or third positions 48, shown in full lines in FIG. 2, in which the marking members 42 are individually, slidably received by their free end portions 43 in the slots 22 and the marking flap is slidably received by its free end portion beneath the longitudinal portion 34 of the second construction blank 31.

For illustrative convenience, the appliance 10 is shown in FIG. 3 in a typical operative environment. As shown therein, a book 50 has a cover 51 having an outer edge 52. The outer edge of the book is shown in phantom lines in FIG. 2. The book has a multiplicity of pages 53 bound in the conventional manner along a spine or binding 54 for the book.

Second Form

Figure 4:
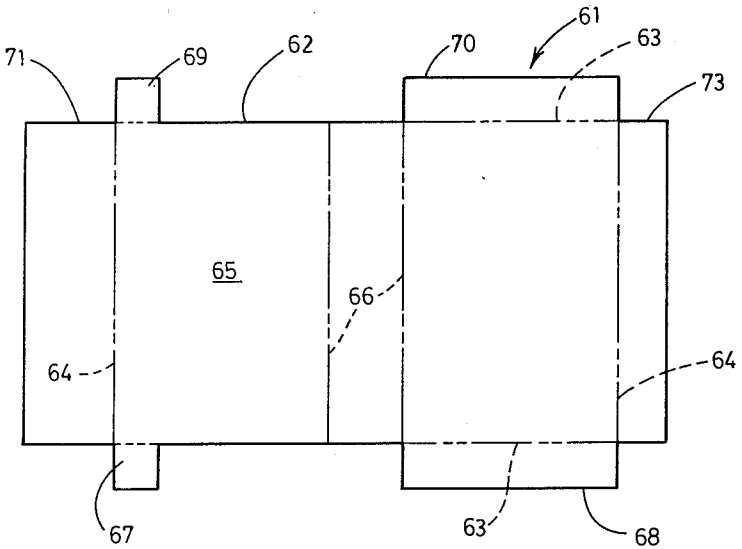
FIG. 4 is a plan view of the appliance of the second form of the present invention shown in a preassembled, substantially flat configuration.

The appliance 60 of the second form of the present invention is shown in FIGS. 4, 5, 6, and 7. The appliance 60 is formed from a construction blank 61 of sheet material which is assembled to form an outer jacket or secondary cover 62. The construction blank 61 has longitudinal marginal fold lines 63 extending generally along the longitudinal edges thereof as shown in FIG. 4. The construction blank has transverse marginal fold lines 64 extending between the longitudinal marginal fold lines and defining an outer panel 65 therebetween. The outer panel has a pair of substantially parallel central fold lines 66 intermediate the transverse marginal fold lines 64.

The lower longitudinal marginal fold line 63, as viewed in FIG. 4, delineates a left lower flap 67 and an opposite right lower flap 68. The upper longitudinal marginal fold line 63, as viewed in FIG. 4, delineates a left upper flap 69 and an opposite right upper flap 70. The transverse marginal fold line 64 on the left, as viewed in FIG. 4, delineates a left side flap 71. The transverse marginal fold line 64 on the right, as viewed in FIG. 4, delineates a right side flap 73.

The outer jacket 62 is formed from the construction blank 61 in a manner similar to that previously described with respect to the construction blank 11 of appliance 10. The left and right lower flaps 67 and 68 and the left and right upper flaps 69 and 70 are individually folded about their respective longitudinal marginal fold lines 63 into facing engagement with the outer panel 65. Subsequently, the left and right side flaps 71 and 73 are folded about their respective transverse marginal fold lines 64 into facing engagement with their respective upper and lower flaps and adhesively fastened thereto using a suitable adhesive. So formed, the outer jacket or cover 62 is provided with a left pocket 76, defined by the left side flap 71 and the outer panel 65, and a right pocket 77 defined by the right side flap 73, the lower and upper flaps 68 and 70 and the outer panel 65.

Figure 5:
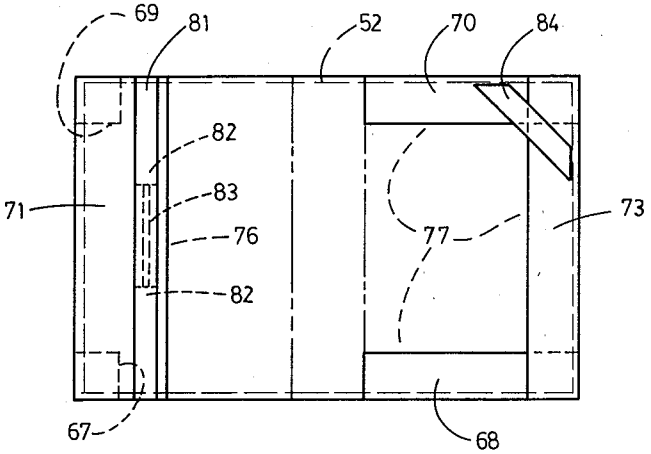
FIG. 5 is a plan view of the appliance of FIG. 4 shown in an assembled condition with the cover of a book shown in phantom lines as installed therein and the marking members thereof shown in representative positions thereon.
Figure 7:
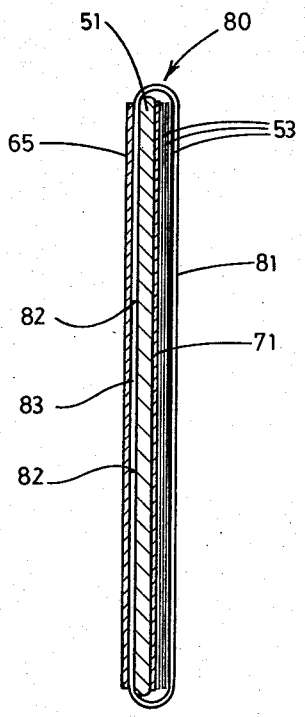
FIG. 7 is a transverse section taken on line 7—7 of FIG. 6.
Figure 6:
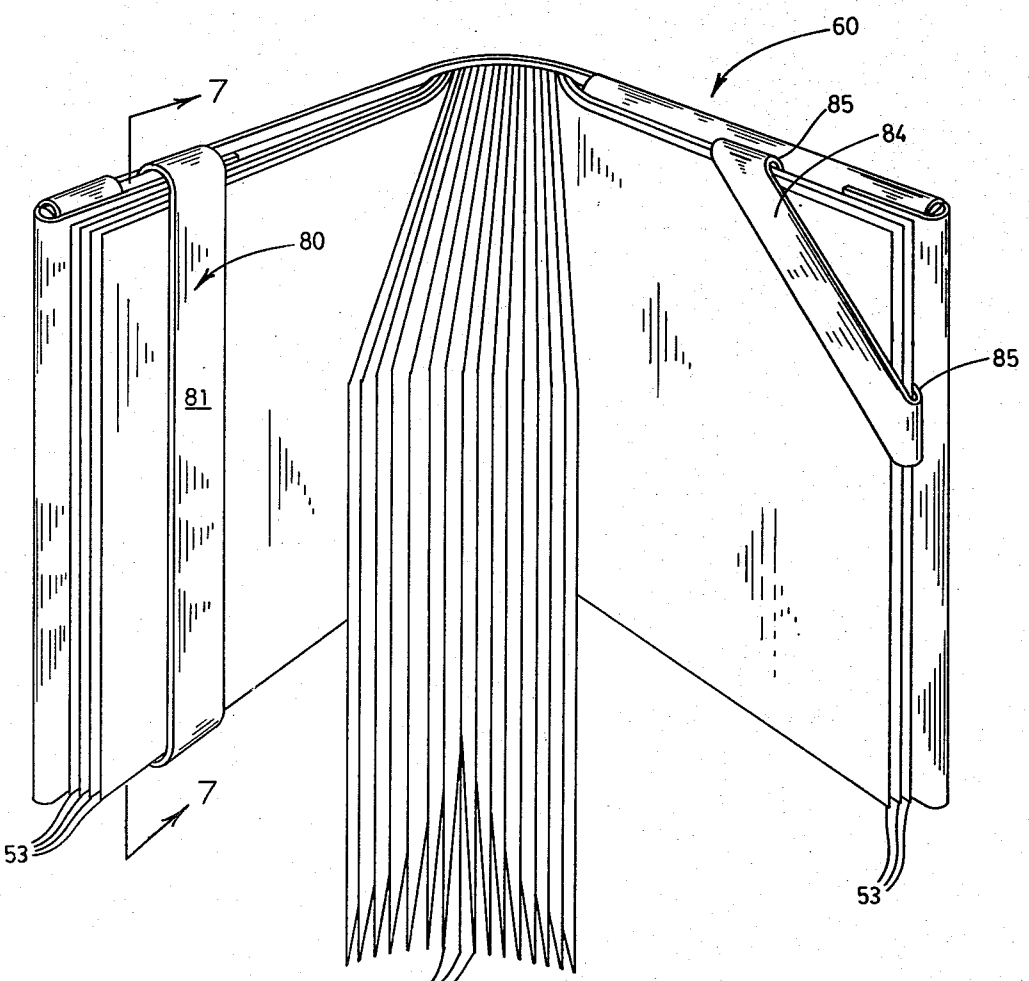
FIG. 6 is a perspective view showing a book with the appliance of the second form of the present invention installed thereon in a representative operative configuration.

The appliance 60 has a marking member or slide assembly 80. The slide assembly consists of an elongated slide member 81 having opposite end portions 82. The opposite end portions are return bent toward each other and interconnected by a resilient bank 83. As shown in FIG. 5, the slide assembly can be fitted about the portion of the left side flap 71 extending toward the central fold lines 66 particularly prior to installation of the appliance 60 on a book. For illustrative convenience, the appliance 60 is shown in FIG. 6 installed on book 50. The outer jacket 62 is mounted with the cover 51 slidably received within the left and right pockets 76 and 77. The slide assembly is received about the cover with the opposite ends thereof and the resilient band extending between the cover 51 and the outer panel 65 of the outer jacket 62 of the appliance, as best shown in FIG. 7.

The appliance 60 has a diagonal marking member 84 having opposite end portions 85. The opposite end portions 85 are folded backwardly and individually adhesively attached to the right upper flap 70 and the right side flap 73, as best shown in FIG. 6.

OPERATION

The operation of the described embodiments of the subject invention is believed to be readily apparent and is briefly summarized at this point. The appliances 10 and 60 of the first and second forms of the present invention respectively are installed on a book 50 in substantially the same manner. Thus, the cover 51 of the book is slidably inserted in the left and right pockets 36 and 37 of the appliance 10 and the left and right pockets 76 and 77 of the appliance 60. This mounts the outer jackets 12 and 62 thereof in covering relation to the cover 51 of the book, as shown in FIG. 3 with respect to appliance 10 and in FIG. 6 with respect to appliance 60. The outer panels 15 and 65 respectively of the appliances are folded about the spine of the book along the central fold lines 66.

In the case of appliance 10, the marking members 42 and the marking flap 44 can be stowed, as shown in FIG. 2 and heretofore described. When so arranged, the marking members and marking flap do not interfere with normal usage of the book, but are retained in positions ready for use when needed. If, for example, it is desired to use one of the marking members 42 to mark a particular page in the book, a selected one of the members is removed from its respective slot 22 and moved to the extended position 46 shown in FIG. 2. Subsequently, the pages 53 of the book are separated at the location to be marked and the marking member is moved to the marking position 47, such as shown in FIG. 3. Thereafter, the book can be closed or other areas of the book can be used as desired.

A similar process is employed when the marking flap 44 is to be used. It will be seen that all three of the marking members 42 and the flap 44 can be employed at one time to mark various distinct portions of the book as may be desired. It will also be seen that the appliance 10 can be constructed in various embodiments fitted with as many marking members and marking flaps as may be desired and in virtually any combination desired without interfering with use either of the book or of the appliance as a protective cover for the book.

Use of the appliance 60 is somewhat different from that heretofore described with respect to appliance 10. The slide assembly 80 can be employed to mark pages of the book. This may most expeditiously be accomplished by sliding the slide assembly to the left as viewed in FIGS. 5 and 6 and inserting the number of pages thereunder which may be desired for marking a particular place in the book. Thereafter, the slide assembly can be slidably moved to the right as viewed in FIGS. 5 and 6 to mark a particular location. If the slide assembly is moved all away to the right as viewed in FIG. 6, some usage of the pages under the slide assembly can be achieved without substantial interference from the slide assembly and while still marking the position selected. The resilient bank 83 permits the opposite end portions 82 of the slide member to be drawn from each other to provide greater area during removal or insertion of pages under the slide member and to facilitate usage of any pages under the member.

Use of the diagonal member 84 is simply accomplished by inserting the desired pages between the diagonal member and the outer jacket 62 of the appliance to retain the pages in position as shown in FIG. 6.

It will be seen that the various marking members 42, marking flap 44, slide assembly 80 and diagonal member 84 can be employed in a selected embodiment of the present invention in any desired combination as may best suit the needs of the particular operative embodiment in which they are to be used and without departing from the scope of the present invention.

Furthermore, the appliances 10 and 60 are removable from any book on which they are installed simply by sliding the cover from the pockets thereof.

Therefore, the appliance of the present invention achieves the capability of providing a protective cover for books, pamphlets and the like of virtually any size or form of construction while affording the capability for marking a plurality of positions within the book at the selection of the user in a device which is both convenient in use and economical to purchase.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. An appliance for a book or the like having a multiplicity of pages bound together along a spine and enclosed by a primary cover, the appliance comprising:

A. a flexible, substantially rectangular outer panel dimensioned to be disposed in covering relation to the primary cover, the outer panel having substantially parallel opposite lateral edges at opposite ends thereof and substantially parallel marginal edges substantially normal to said lateral edges;

B. a first inner panel secured in facing relation to said outer panel and adapted to receive a portion of said primary cover between the outer panel and the first inner panel;

C. a second inner panel secured in facing relation to the outer panel and adapted to receive a portion of said primary cover between the outer panel and the second inner panel; and D. a plurality of elongated flexible members borne by the appliance in spaced relation to each other along a marginal edge, said members individually having free ends adapted for interposition between selected adjacent pages of said book, one of said inner panels having a plurality of slots therein positioned and dimensioned individually to receive the free ends of said flexible members in stored positions.

* * * * *